United States Patent [19]

Cook

[11] 4,103,470

[45] Aug. 1, 1978

[54] STRESSED SKIN STRUCTURAL DIAPHRAGM

[76] Inventor: Charles E. Cook, 1515 Lilac La., Liberty Lake, Wash. 99019

[21] Appl. No.: 732,192

[22] Filed: Oct. 14, 1976

[51] Int. Cl.[2] ..... E04C 2/00

[52] U.S. Cl. ..... 52/794; 52/650; 428/106

[58] Field of Search ..... 428/106, 137, 131, 132, 428/133, 109, 110; 52/648, 650, 615, 222, 622

[56] References Cited

U.S. PATENT DOCUMENTS

| | | | |
|---|---|---|---|
| 794,295 | 7/1905 | Gervais | 52/622 |
| 3,370,393 | 2/1968 | Hale | 52/615 |
| 3,490,187 | 1/1970 | Stauffer | 52/615 |
| 3,837,985 | 9/1974 | Chase | 52/622 |

FOREIGN PATENT DOCUMENTS

| | | | |
|---|---|---|---|
| 1,224,180 | 6/1960 | France | 428/106 |
| 1,492,193 | 7/1967 | France | 52/615 |
| 1,214,382 | 4/1966 | Fed. Rep. of Germany | 428/106 |

*Primary Examiner*—Ernest R. Purser
*Assistant Examiner*—Henry Raduazo
*Attorney, Agent, or Firm*—Wells, St. John & Roberts

[57] ABSTRACT

A roof or ceiling structure for buildings in the nature of a "space frame" or three-dimensional truss, including substantially planar panels and supporting struts and a method for producing the structure on-site. The panels serve a dual purpose as structural members interconnecting the struts and as surface elements for a roof or ceiling. Two panels spaced parallel to one another are interconnected by equiangular struts to form an array of tetrahedrons throughout the three-dimensional structural member. Each panel is made up from sheet material, and the seams between panels are accommodated by rotating each layer of panels relative to those adjacent to it so that the seams overlap abutting sheet surfaces in differing angular attitudes.

9 Claims, 19 Drawing Figures

FIG. 3
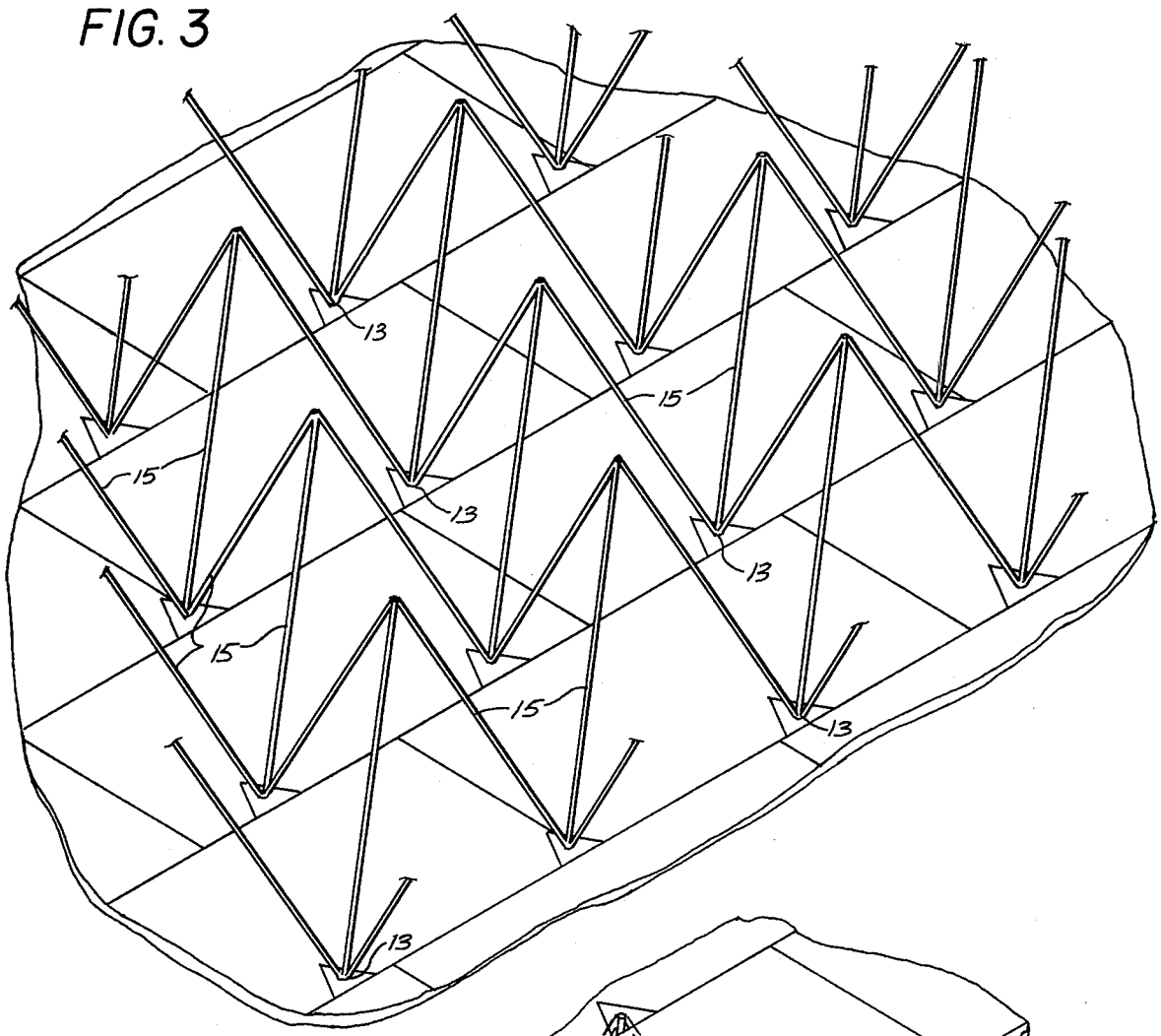
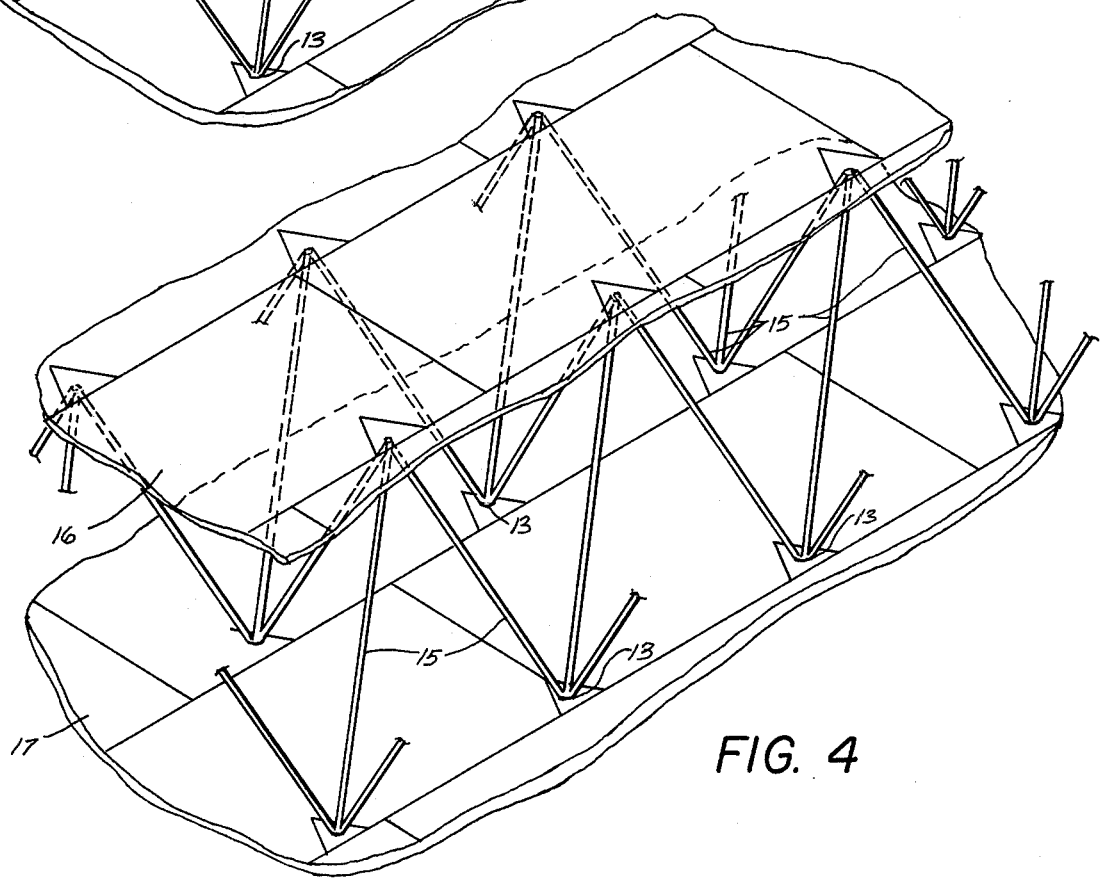
FIG. 4

10
20
21
22
23
24
25
26
30

24
25
26
27

FIG. 18
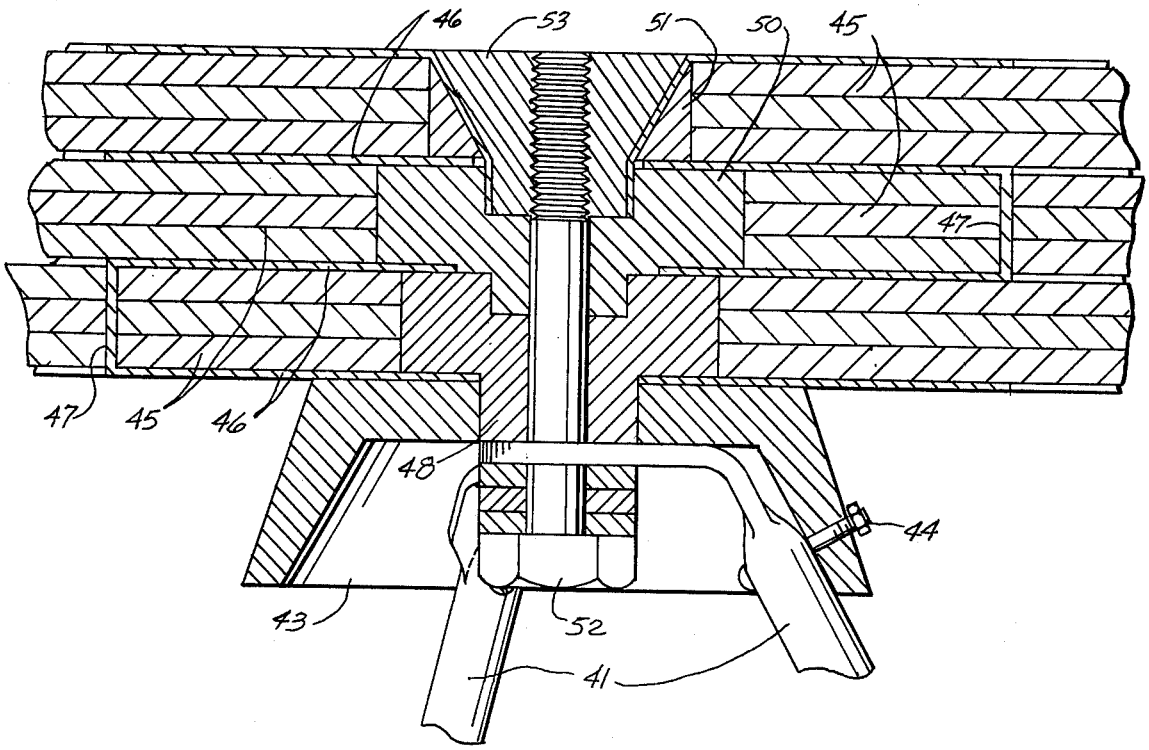
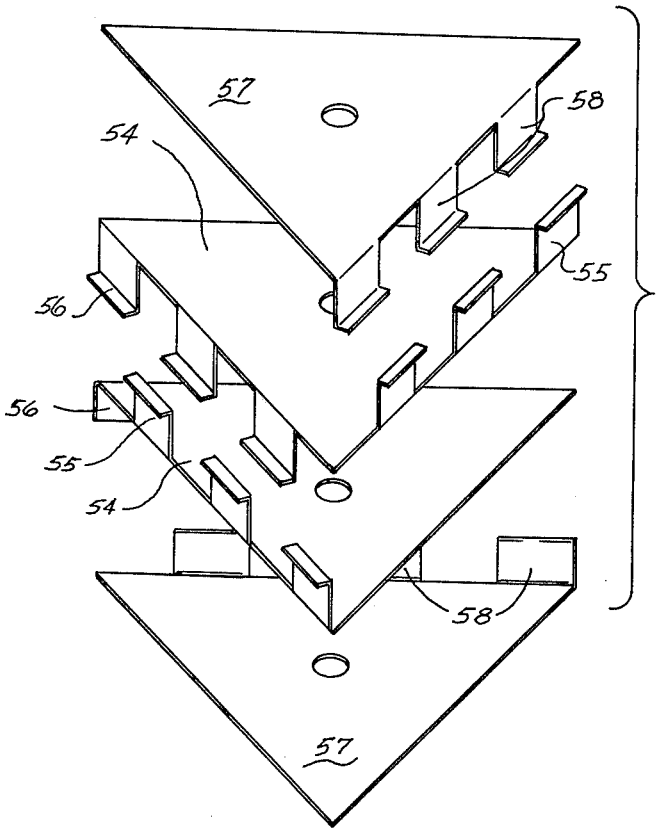
FIG. 19

STRESSED SKIN STRUCTURAL DIAPHRAGM

BACKGROUND OF THE INVENTION

This invention relates to "space frames", used as self-supporting roofs or ceiling systems in buildings, where an unobstructed span is desired in both length and width. A space frame includes upper and/or lower panels interconnected by struts. The substantially plane panels or "skins" are loaded in compression or tension, depending upon the three-dimensional truss loading pattern of a particular system.

This disclosure is concerned primarily with the production of such a system from plywood panels, which typically are supplied in rectangular sheets of limited width and length. One task faced by any designer of a plywood structure is that of utilizing the limited dimensions of available plywood in the production of spans that are a multiple of such limits. While plywood can be produced at the mill in extended length sheets by use of scarf joints and other end-to-end bonding techniques, these methods require expensive presses and forming machinery. They are only of limited value where increased dimension is necessary in both length and width of a sheet. Such methods normally cannot be carried out at a building site, and the ultimate sheet size that can be produced at a mill is limited by size limitations during shipment from the mill to a building site.

Space frames in general have been previously utilized to span a building area. Many of these have used self-supporting skeletal frames covered by a non-structural skin of lightweight metal or other sheet material. The key feature herein is the novel utilization of conventional sheets of plywood or other structural sheet material to produce large areas of panels for inclusion in such systems.

SUMMARY OF THE INVENTION

The disclosed product or system basically comprises two or more channels formed from rows of structural sheet material, the panels being overlayed on one another and spanning the desired length and width of the building area. Each layer of material has equally spaced points located along its full length and width. These points are located along lines developed parallel to one edge of each row and offset longitudinally midway between the points along each line adjacent to it. The spacing between the lines and points is such that any three adjacent points form an equilateral triangle. The layers are superimposed on one another with these points of each layer coincident to one another and with the respective side edges of the rows of sheet material in abutting layers being angularly offset from one another by 120°. Thus, the edges of the sheets angularly cross one another and no two sheet edges in any layer can be in a coincident position. When the layers are bonded to one another, the overlapping edges assure surface-to-surface force transmission throughout the area of the resulting panel.

The above panel is utilized as the skin of a structural diaphragm. This is accomplished by connecting tetrahedral struts to the points located on the panel and by interconnecting the outer ends of each strut to complete a three-dimensional truss configuration. When desired, this latter interconnection can be accomplished by use of a second panel identical to and parallel to the first panel.

The method of producing the structural diaphragm comprises first the step of locating connection points or apertures in each row of sheet material. In the case of plywood sheets, the points are located parallel to one long edge of each sheet and are spaced transversely the height of a single sheet. They are spaced equally from one another as points of equilateral triangles. The rows of sheet material are then placed in abutment with one another, with the connecting points of one row being longitudinally offset midway between those of the rows adjacent to it. The connecting points along adjacent rows of sheets form equilateral triangles. Multiple layers are produced in this manner and superimposed one on the other with the side edges of the rows angularly offset 120° from one another and the connecting points coincident. These points can then be secured to tetrahedral struts and to a second spaced panel to complete a structural system for a roof or ceiling or both.

A first object of this invention is to provide a practical method of utilizing plywood or similar sheet material conventionally produced in sheets of limited length and width, wherein the material can be incorporated into large panel areas involving substantial multiples of such limited dimensions.

Another object of this invention is to provide practical hardware for fabricating stressed skin structural diaphragms from plywood.

Another object of this invention is to provide a system whereby the components of the structural diaphragm can be fabricated and assembled at the building site.

These and further objects will be evident from the following disclosure, taken together with the accompanying drawings. The drawings illustrate the conceptual basis of the disclosure and several variants in hardware and fabrication.

DESCRIPTION OF THE DRAWINGS

FIG. 3 is a fragmentary perspective view showing a panel and upstanding strut assemblies;

FIG. 4 is a similar perspective view, showing the completed diaphragm;

FIG. 18 is a view similar to FIG. 17, showing a modified bracket assembly for an upper panel; and FIG. 19 is an exploded perspective view of still another embodiment of a bracket for the panel.

DESCRIPTION OF THE PREFERRED EMBODIMENT

This invention relates to a stressed skin structural diaphragm or "space frame", wherein the structural skin is produced from repeated sheets of material placed end to end in rows parallel to one another. The sheets abut one another in an edge-to-edge relationship across the full width of the building area to be spanned thereby.

One key feature of this system is the utilization of three-dimensional tetrahedral structures interlocking parallel spaced panels, with the panels themselves serving as planar struts or connectors in the tetrahedral system.

In order to produce a large area panel from conventional sheets of plywood or other structural materials, such as rectangular sheets of plywood, wood veneer, particleboard or other wood-based material, each panel is constructed in a multiple number of layers. This number is preferably three, but can be as few as two where adequate surface-to-surface bonding between the layers can be assured, or can be any greater number of layers as required for strength purposes. Three layers produces a balanced structural system in connection with the tetrahedral supports.

In general, this method of producing a stressed skin structural diaphragm comprises the following steps: (1) arranging a plurality of longitudinal rows of sheet material in side-by-side abutting positions; (2) locating equally-spaced points along at least one line parallel to one corresponding side edge of each row of sheet material, the points along each adjacent pair of rows being offset longitudinally midway between one another, whereby the points located along adjacent rows form equilateral triangles; (3) arranging the rows of sheet material in parallel side-by-side abutting positions covering the area to be spanned; and (4) arranging a second layer of identical rows of sheet materials over the first, with the points located in the second layer coincident to the points located in the first layer and with the corresponding side edges of the two layers being angularly offset relative to one another.

Figure 1:
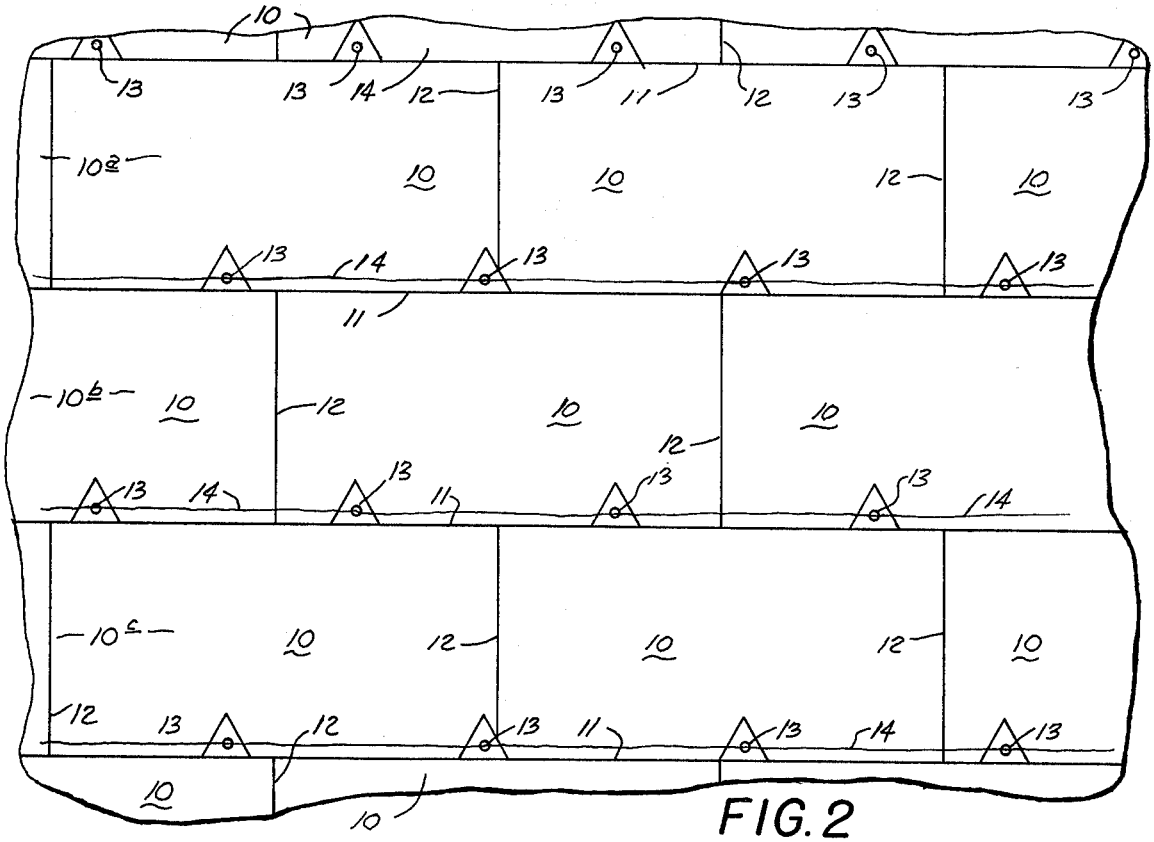
FIG. 1 is a fragmentary plan view of a single layer of sheets for a diaphragm.

FIG. 1 illustrates a first layer of a panel. It is comprised of rectangular sheets of material 10 arranged end to end in longitudinal rows indicated as 10*a*, 10*b*, 10*c*, etc. These rows are arranged parallel to one another with their adjacent longitudinal edges in abutment. The transverse edges of each sheet abut those sheets adjacent to it in each row. The longitudinal edges in FIG. 1 are designated by the numeral 11 and the transverse edges by the numeral 12. In the United States, plywood sheets are conventionally produced with a longitudinal dimension or length of eight feet and a transverse dimension or width of four feet. The object of this disclosure is to describe a system for producing large panels having both length and width dimensions which are many times these conventional sheet dimensions, the ultimate dimensional limits of the panel being determined by the design load limits of the resulting three-dimensional truss.

Located along each row of material are connecting points. The connecting points are schematically illustrated in FIG. 1 by circles 13. They are equally spaced along imaginary or real lines 14 parallel to the longitudinal edges 11 of that row. The connecting points 13 along adjacent lines 14 are staggered longitudinally so as to be located or interspersed midway between one another. Every point 13 across the entire panel is equally spaced from every other point adjacent to it. Any two points 13 on one line and their intermediate points 13 on adjacent lines form equilateral triangles. The height of each triangle is the lateral or transverse spacing between the adjacent lines 14. The spacing of adjacent points 13 along line 14 equals the straight line space between each point 13 and the intermediate points 13 on an adjacent line 14.

In the illustrated forms of this invention, the spacing between lines 14 equals the transverse width of each sheet 10. In this manner, each line 14 is spaced inwardly of the adjacent longitudinal sheet edges 11 by an equal distance. This facilitates construction of the panel, since the points are located identically along each row of sheets. However, the spacing illustrated constitutes the maximum spacing that is practical between lines 14. Lines 14 can be spaced apart by a distance less than the sheet width, which would then require re-scaling of the separation between points 13 along the respective lines 14. A lesser spacing between lines 14 might also pose fabrication difficulty in locating lines 14, which would vary in position along each row. Were the spacing between line 14 to be greater than the width of the sheets, certain rows of sheets would eventually not contain any lines 14 or points 13. It is intended that every row of sheets contains at least one line of connecting points 13.

Figure 2:
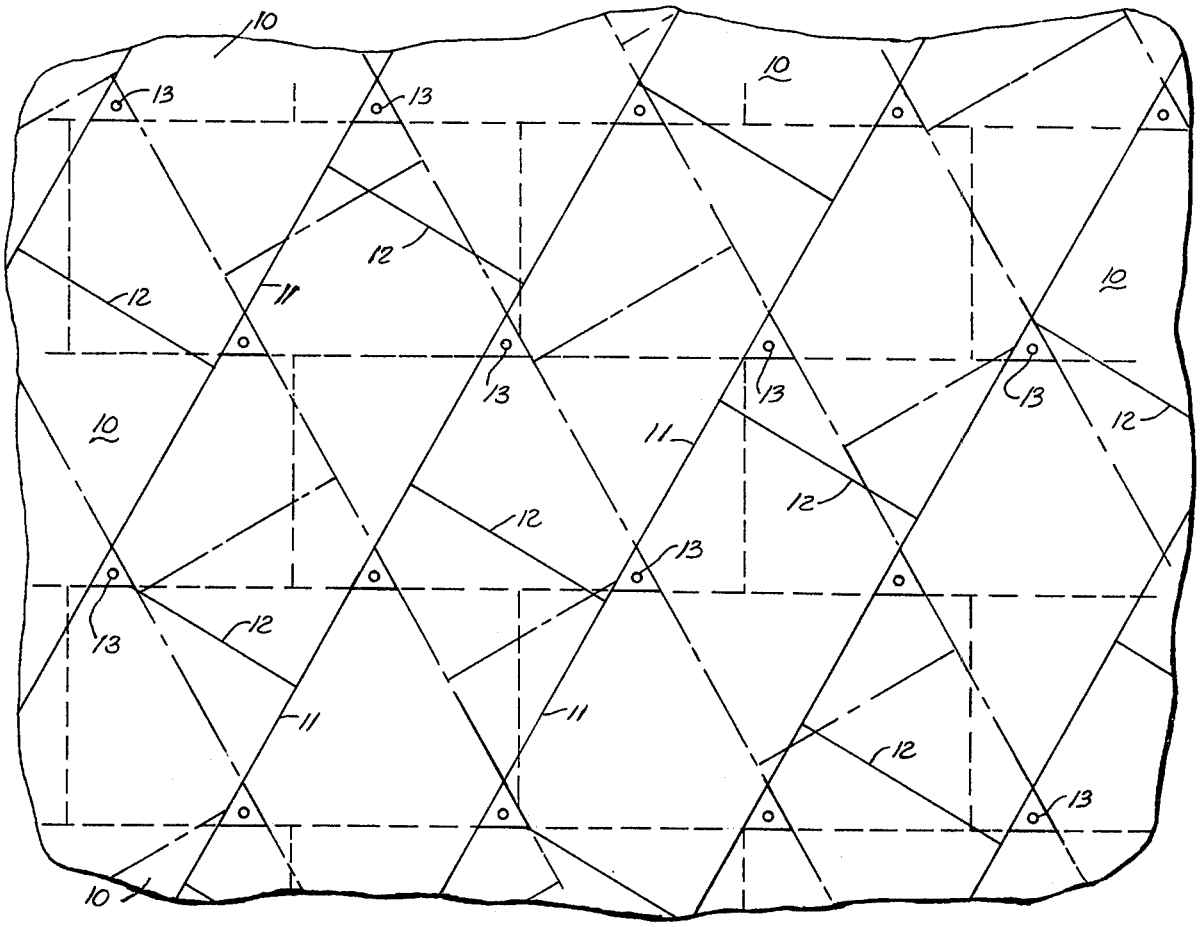
FIG. 2 is a plan view showing the superimposed layers in a single panel.
Figure 5:
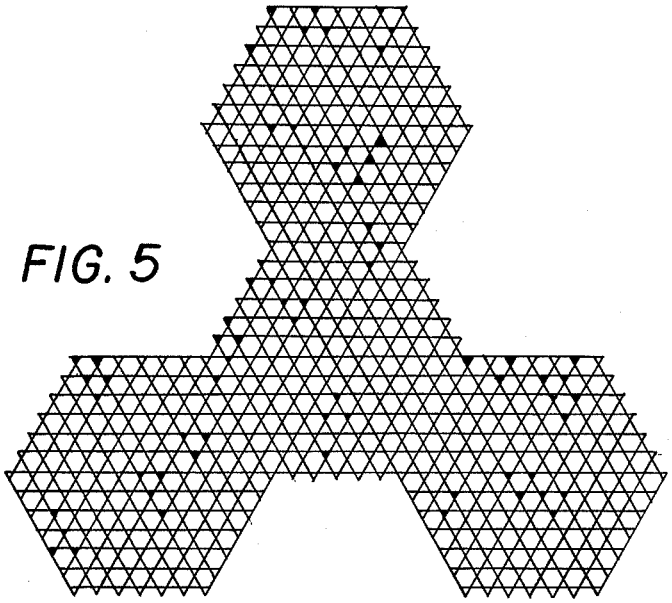
FIGS. 5-9 are simplified schematic views showing various area formations.
Figure 6:
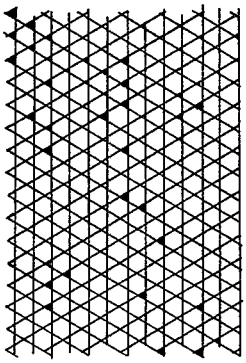
Figure 7:
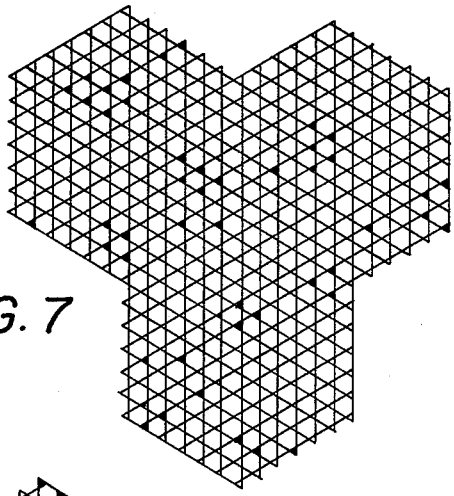
Figure 8:
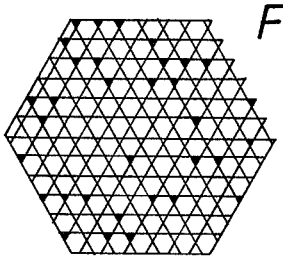
Figure 9:
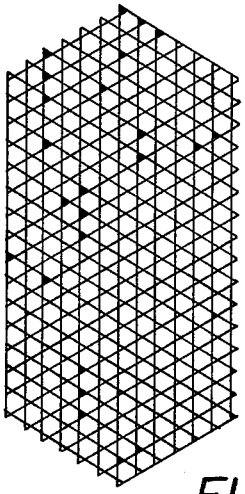
Figure 10:
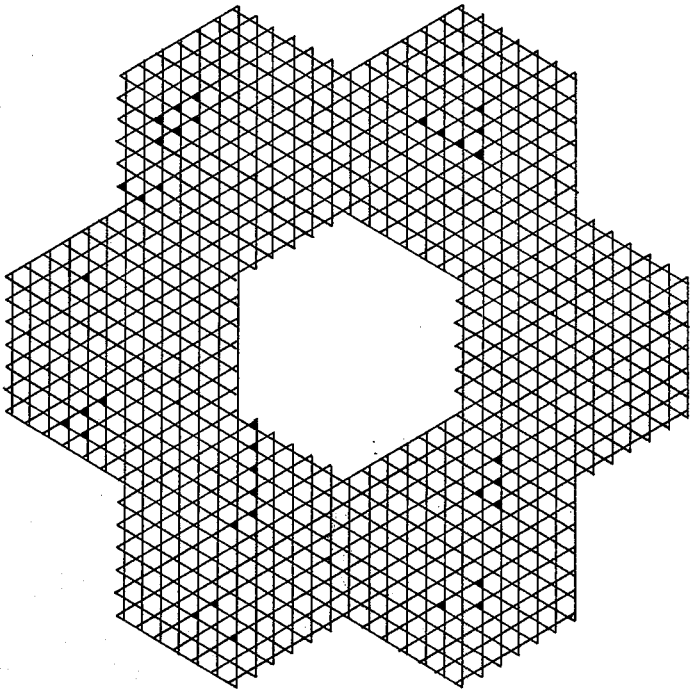
FIG. 10 is an additional schematic view showing a plan having an open center.
Figure 11:
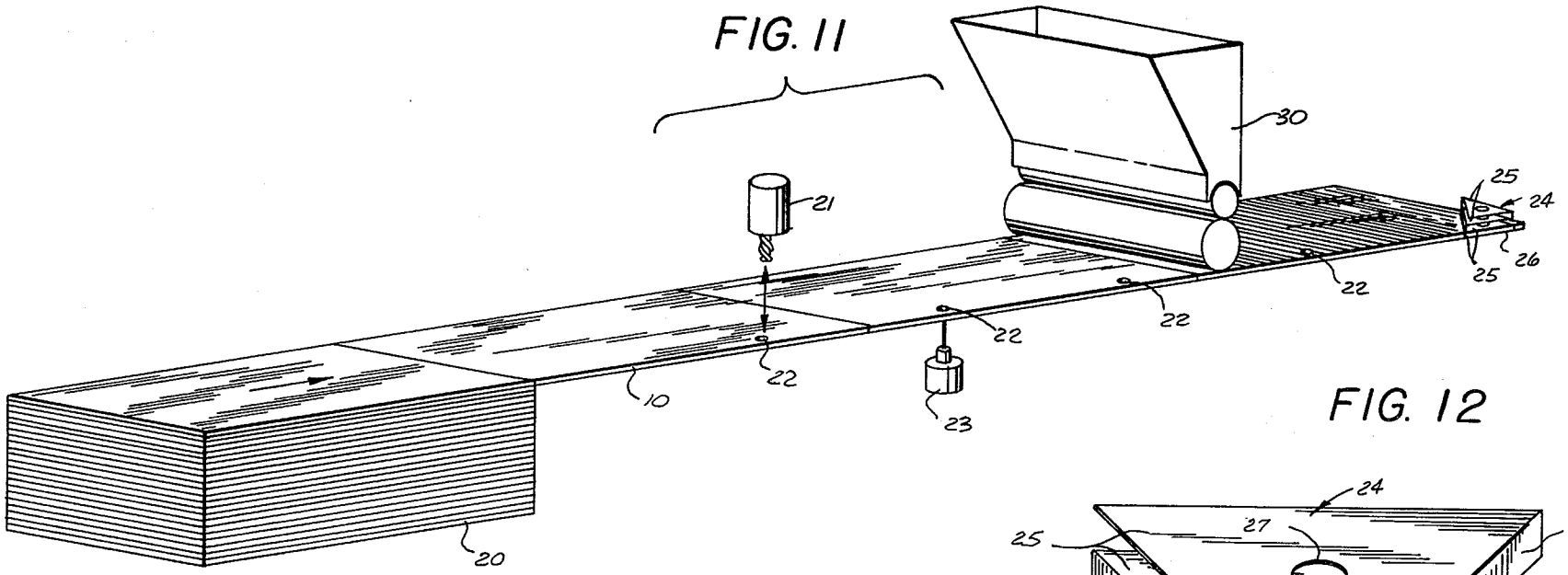
FIG. 11 is a schematic view illustrating preparation of a row of sheets.
Figure 12:
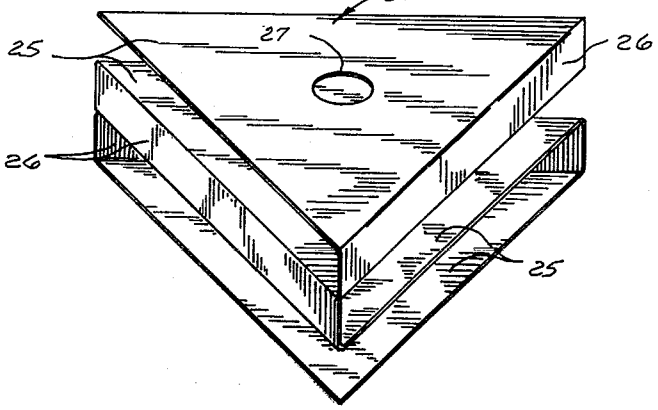
FIG. 12 is a perspective view of a bracket for the panels.
Figure 13:
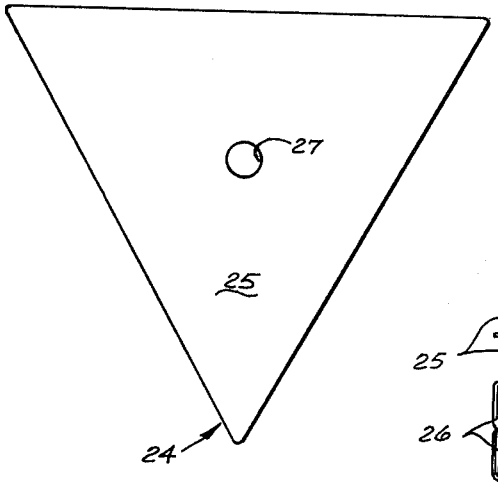
FIG. 13 is a plan view of the bracket shown in FIG. 12.
Figure 14:
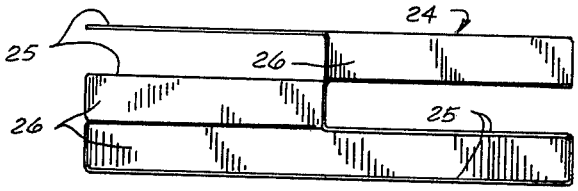
FIG. 14 is a side view of the bracket shown in FIG. 12.
Figure 15:
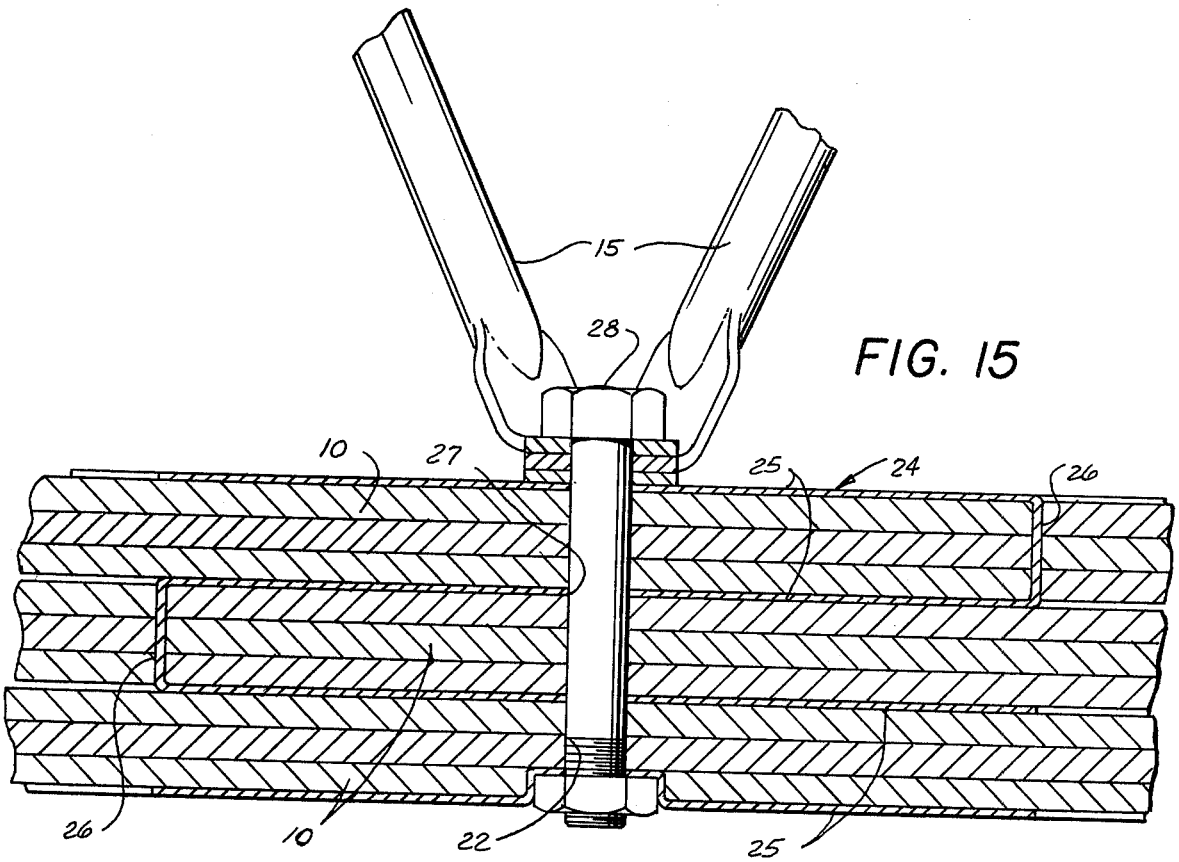
FIG. 15 is a sectional view through a panel at the strut connection point.
Figure 16:
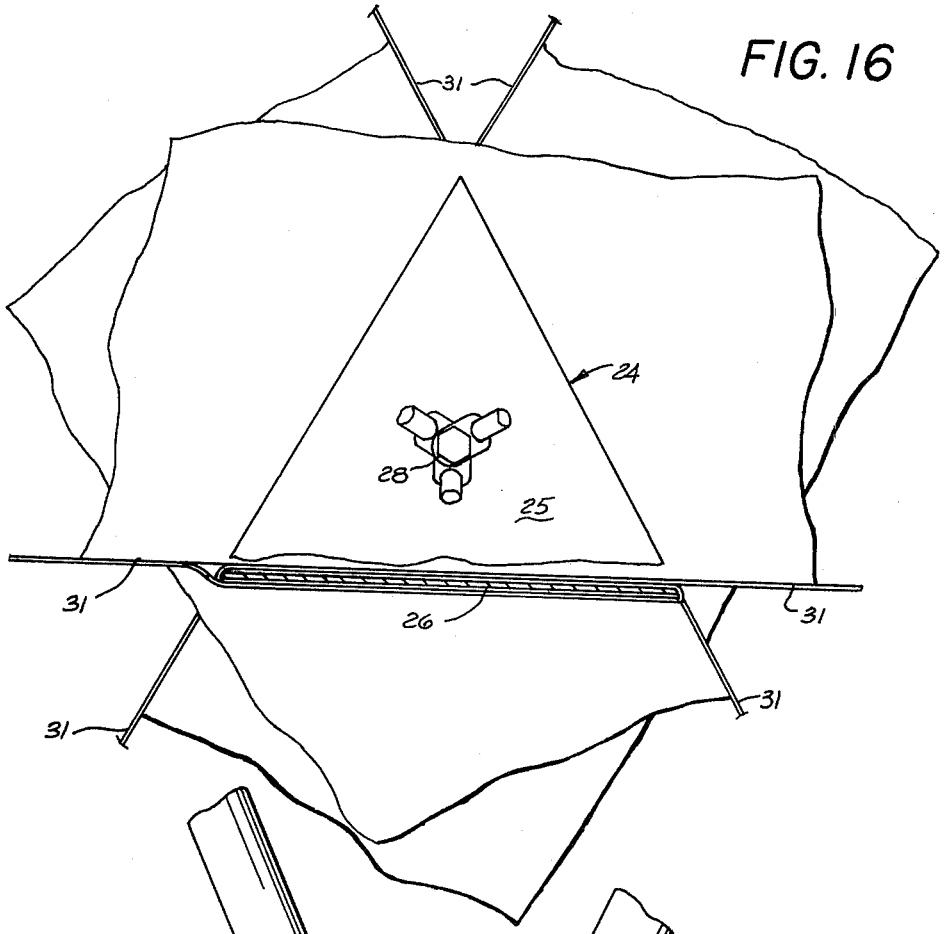
FIG. 16 is a fragmentary plan view showing attachment of the bracket to a panel.
Figure 17:
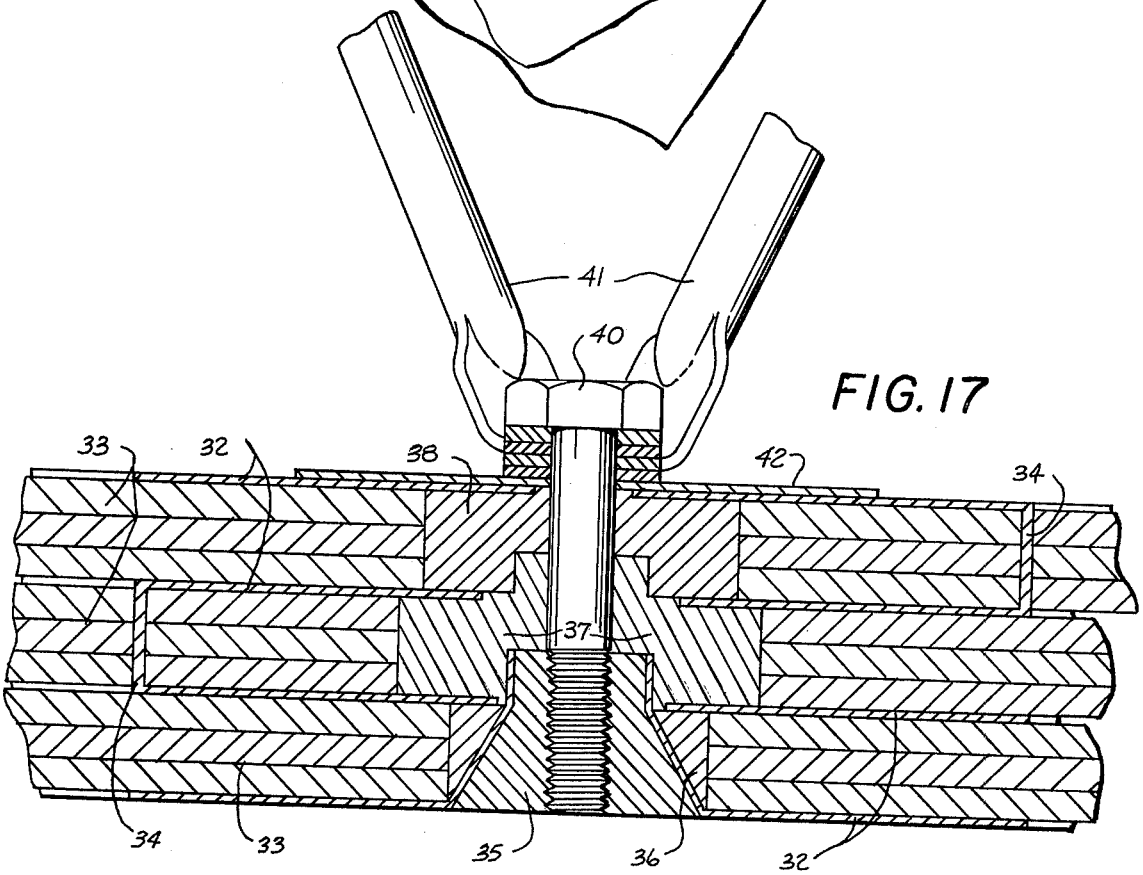
FIG. 17 is a sectional view through a connecting point in a lower panel assembly, showing a modified bracket assembly.

To produce the panel utilized in this system, it is preferable that three separate layers be fabricated as shown in FIG. 1 and be superimposed one on the other in surface-to-surface contact as shown in FIG. 2. As seen in FIG. 2, the points 13 on each layer are coincident or coaxial along lines perpendicular to the surfaces of the layers. In FIG. 2, which is a plan view looking on the panel section, the sheets 10 in the uppermost layer are shown in full lines, the sheets in the intermediate layer are illustrated by alternate long and short broken lines, and the bottom layer sheet boundaries are illustrated by short broken lines. While the points 13 are coincident, the edges of the sheets in adjacent layers are rotated or turned 120° with respect to one another. This assures substantial surface overlapping between the adjacent layers and angular offsetting of the seams between the abutting sheets in the layers.

FIG. 3 illustrates the next basic step in production of the structural diaphragm. This is the addition of outstanding equiangular struts 15, each of which has an effective connected length between its ends identical to that of every other strut. This effective length also is identical to the spacing between the points 13 located on the panel layers. The struts are arranged along one side of the panel and project outwardly therefrom. They are connected in clusters or groups of three each at a connecting point coincident to one of the points 13. They diverge equiangularly from the point 13 at an angle of 60° with respect to the plane of the panel surface. Their outer ends are joined also in groups of 3 and the struts 15 form tetrahedral structural elements across the entire area of the panel. Struts 15 are rigid. They can be constructed from metal, plastic, wood or any other suitable material. The base of each tetrahedron is also rigid, particularly in view of the fact that every pair of connecting points in the panel includes at least one layer of unbroken sheet material spanning the two points.

As illustrated in FIG. 4, the basic features of the structural diaphragm are completed by a second panel along at least one line on each row of sheet material, each line being parallel to the side edges of the row containing it, the apertures along each line being offset longitudinally midway between the apertures along each line adjacent to it and the spacing between the lines and apertures being such that any three adjacent apertures form an equilateral triangle;

each layer being superimposed on an adjacent layer with the apertures located thereon coincident with one another and the respective side edges of the rows of sheet material being angularly offset 120° from one another about said apertues.

2. A structural diaphragm as set out in claim 1 wherein the apertures formed through each row of sheet material are located along a single line spaced inwardly an identical distance from one corresponding side edge of the row.

3. A structural diaphragm as set out in claim 1 including three layers superimposed one on the other and co-extensive in length, width and peripheral configuration.

4. A structural diaphragm as set out in claim 1 wherein each row is comprised of rectangular sheets arranged in end-to-end abutting relationship with one another.

5. A structural diaphragm as set out in claim 1, further comprising:

a plurality of rigid struts each having an effective length between the ends thereof equal to the separation between adjacent apertures along said lines;

each strut being connected in a group of three struts joined to one another, each group being joined to the layers of sheet material through a selected one of said apertures and extending outward to one side of the layers of sheet material, said struts in each group diverging equiangularly relative to one another to form tetrahedral structures in combination with the layers of sheet material;

and means joining the remaining ends of the struts along a plane parallel to and spaced from the layers of sheet material.

6. A structural diaphragm as set out in claim 5 wherein said last-named means comprises a second panel identical to that set out in claim 1, the remaining ends of said struts being connected to said second panel in groups of three struts at each point located on the second panel.

7. A structural diaphragm, comprising:

a plurality of layers of structural sheet material;

each layer including a plurality of planar sheets arranged along parallel rows in edge-to-edge abutting positions fully covering the desired panel area;

each row of sheets having apertures formed through them along lines parallel to one corresponding edge of the row, the apertures being located on said sheets such that any three adjacent apertures along any two adjacent lines across the layer form the corners of an equilateral triangle;

the respective layers being overlaid one on the other, with said rows of sheets along adjacent layers being turned 120° with respect to one another about each aperture, the apertures of the layers being in coaxial registry with one another.

8. A structural diaphragm as set out in claim 7, wherein the sheets are rectangular sheets of wood-based material.

9. A structural diaphragm as set out in claim 7 wherein the height of the equilateral triangles formed by said apertures equals the width of a single row of sheets.

* * * * *